United States Patent [19]

Retelny

[11] 4,061,241

[45] Dec. 6, 1977

[54] FOOD PLATE PACKAGE

[75] Inventor: Andrew G. Retelny, Wheaton, Ill.

[73] Assignee: McDonald's Corporation, Oak Brook, Ill.

[21] Appl. No.: 727,293

[22] Filed: Sept. 27, 1976

[51] Int. Cl.[2] ..... B65D 1/34; B65D 43/10; A45C 11/20

[52] U.S. Cl. ..... 220/4 B; 206/508; 206/511; 206/545; 220/306; 229/2.5 R; 229/43

[58] Field of Search ..... 220/4 B, 4 E, 306; 229/2.5, 43; 206/508, 511, 512, 540, 541, 545, 549

[56] References Cited

U.S. PATENT DOCUMENTS

| | | | |
|---|---|---|---|
| Re. 28,720 | 2/1976 | Sedlak | 206/508 |
| 3,244,311 | 5/1966 | Lawson | 220/4 B |
| 3,303,964 | 2/1967 | Luker | 206/508 |
| 3,557,995 | 1/1971 | Mirasol | 206/508 |
| 3,613,933 | 10/1971 | Pilz | 206/545 |

*Primary Examiner*—George E. Lowrance
*Attorney, Agent, or Firm*—Robert E. Wagner; Robert E. Browne; Gerald T. Shekleton

[57] ABSTRACT

A food plate package having a bottom plate and a top cover for the temporary storage of prepared food products, the top cover being convex-oval, with support ribs integrally formed in the cover. The support ribs provide a raised flat surface to stably support another food plate package when stacking one on top of the other. Channels are provided between the support ribs for an air space between adjacent packages when stacked and the subsequent dissipation of overly high temperatures in the central portion.

9 Claims, 9 Drawing Figures

FOOD PLATE PACKAGE

BACKGROUND OF THE INVENTION

Fast food restaurants have commonly prepackaged the individual components of a hot meal and placed it on a warming tray or under infrared lamp to keep the food warm until sale and consumption. With the standard sandwich menu of many fast food and carry-out restaurants, these individual packages proved adequate; however, for certain items of the menu, the individual packages proved unsatisfactory, and therfore difficulties were experienced in preparing and packaging these foods ahead of time.

It is desirable that certain items in fast food or drive-in restaurants be capable of being prepared prior to the actual sale and stored for a short period of time in a hot and appetizing condition until sale to a patron. Storage in fast food restaurants generally presents the problem of the efficient use of space. If the prepared food requires a large amount of space by reason of its numbers or size, restaurant operators will stack the individual food items vertically to conserve in space and also to more efficiently dispense the food items.

With individual items, the use of a container roughly the size of the sandwich, having a hinged top for easy access to the food item and composed of a polystyrene material, has proven itself very desirable, for a number of reasons, in keeping the food hot and fresh during the temporary storage period prior to consumption. Due to its relatively small size, there is sufficient structural strength provided by the corners of such a container so that it may be efficiently stacked and stored in large quantities yet only a small amount of counter space is utilized.

However, when such a container is made larger for use with standard meals, such as scrambled eggs and sausage, or perhaps a chicken dinner, it has been found that the hot temperatures at which it is necessary to keep the food can destroy the structural integrity of the polystyrene material and render the packages incapable of being stacked for efficient storage. If a conventional disposable plate and lid or cover were used, those high temperatures necessary for, say, some breakfast items, would cause the plastic material of which it is formed to lose its structure and sag. In so doing, a stack of these conventional plates and lids, when filled with hot food items, would sag, thereby collapsing the plates and lids and crushing the food or unbalancing the stack and causing the stack to topple. Further, even though the temperatures may not be high enough to cause sagging and the subsequent toppling of the packages, the temperature of the stacked packages may be sufficiently high to cause the polystyrene material packages to stick to one another in an undesirable manner.

SUMMARY OF THE INVENTION

It is therefore, an object of this invention to provide the capability of storing hot prepared food for limited periods of time.

It is another object of this invention to provide a food package which has the structural strength to permit the stacking of the food package one on top of another when containing hot prepared food.

It is yet another object of this invention to provide a cooling capability between each food package of a stacked pile of food packages.

A further object of this invention is the most efficient use of space within a food package to provide more efficient heating within the package.

These and other objects are accomplished by the subject invention wherein there is provided a food package or container having a bottom plate and a top lid or cover, the cover being adapted to be placed over all but an outside rim portion of the bottom plate. The cover is spherical, being concave in a side view (FIG. 9) and oval in a top view (FIG. 2), and has a series of strengthening ribs integrally molded into the cover. The overall concave-oval shape of the cover gives it an inherent strength while using a minimum of material. In the interior of the cover, the convex-oval shape provides a minimum of space to be heated while keeping the prepared foods warm.

The raised ribs on the outside of the cover, in addition to providing added strength and a surface for stacking the packages on top of one another, also space a package from the package on which it is supported and thereby provide a cooling effect to both the package surfaces in contact. The foregoing tends to prevent the package from reaching a temperature high enough to weaken and deform, that is, the package retains its structural integrity.

The bottom, or plate, of the food plate package has a flat area onto which the food is placed. About the flat area is a continuous sidewall enclosing the flat area. Spaced from this flat area on the sidewall is a peripheral ridge on which the top cover rests. Above this ridge are handle portions by which the package may be lifted. The sidewall also has slots on opposing sides above the ridge. Tabs, integral with the top cover, are insertable into the corresponding slots for retaining the cover in position over the plate.

When the covers are secured to their plate by the tabs, they may be stacked for temporary storage of the prepared foodstuffs or for take out purposes without structural deterioration of the packages through either instability or deformation through excessive heat of the packages themselves.

DESCRIPTION OF THE DRAWINGS

Further objects of this invention, together with additional features contributing thereto and advantages accruing therefrom, will be apparent from the following description of one embodiment of the invention when read in conjunction with the accompanying drawings, wherein.

DESCRIPTION OF THE INVENTION

Figure 3:
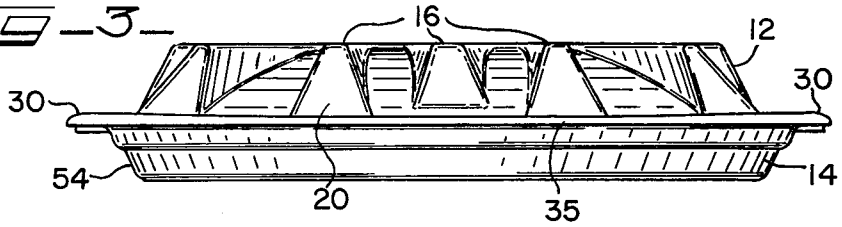
FIG. 3 is a left side view of one embodiment of the subject invention, showing the raised ridges and a bottom plate.
Figure 4:
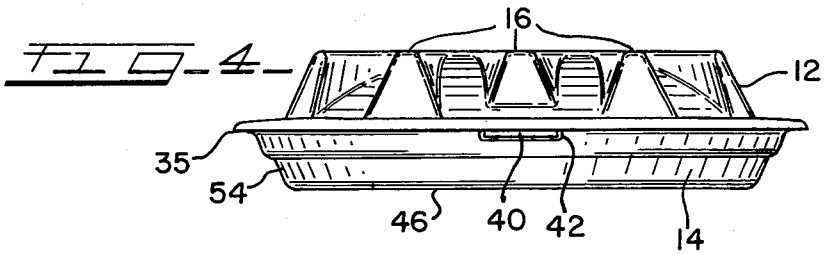
FIG. 4 is a front view of one embodiment of the subject invention, showing the tab and slot retaining means.
Figure 1:
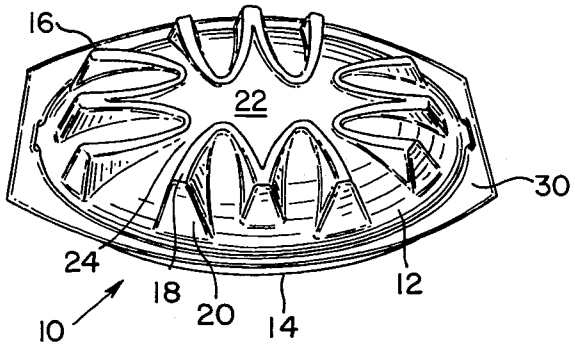
FIG. 1 is a perspective view of one embodiment of the complete package of the subject invention.

Referring to FIGS. 1 and 3, there is shown a food package container 10 having a top cover or lid 12 and a bottom plate 14. These may be formed of any lightweight material, which, though inexpensive enough to be disposable, should possess thermally insulative properties and sufficient strength for the purposes hereinafter described. In general, a foamed polystyrene material, being an excellent thermal insulator, thermoplastic, compatible with foodstuffs and inexpensive, is the material of choice, although other materials having these features may be found suitable.

Figure 6:
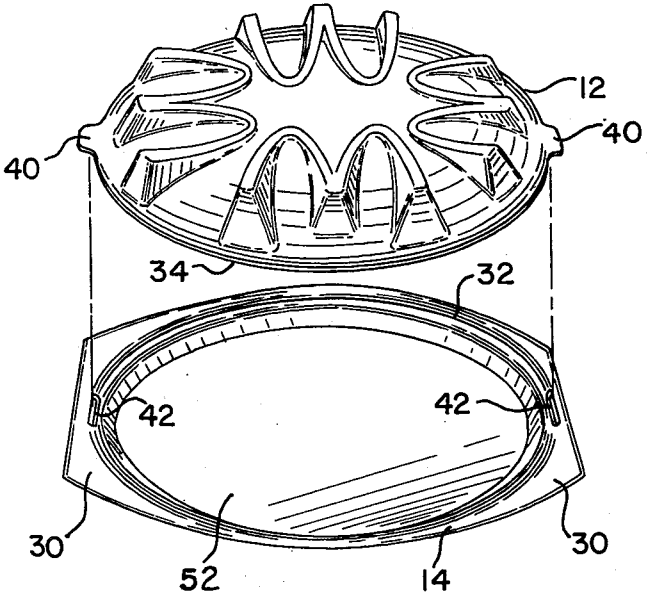
FIG. 6 is an exploded view of one embodiment of the subject invention, showing the ridge on which the cover rests.
Figure 9:
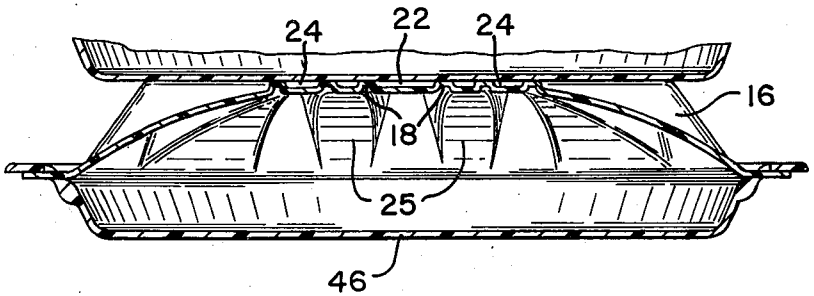

The cover 12, in plan view, is oval in shape and in side view is a partial convex shape (FIG. 9). A peripheral ridge or band 34 (see also FIG. 6) defines the lower edge of the cover 12 and is adapted to rest on a corresponding supportive ridge or band 32 on the plate 14, as shown in FIG. 6. The band 34 of the cover 12, and the band 32 of the bottom plate 14, thus provide an intimate contact or seal to prevent the loss of heat from the food and prolongs the period of time in which food may be kept at an appetizing temperature. The bottom plate 14, which conforms in plan view to the shape of the top cover 12, is substantially bowl-shaped having side walls 54 and a generally flat bottom 46 to give the entire package great stability. The interior plate bottom 53 is also flat, allowing for the placement of various foodstuffs in the conventional manner. The plate portion 14 has a peripherally outwardly flared upstanding side portion 54 which serves to keep the food within the package without leakage of any fluids seeping from or inherent in the food.

The flared side wall 54 also allows nesting of the bottom plate for storage prior to use. The peripheral side portion 54 curls into a lip 35 at its uppermost portion to help retain the integrity of the bottom plate. At opposing ends of this peripheral lip are handles or grips 30, by which the entire food plate package may be lifted.

Figure 2:
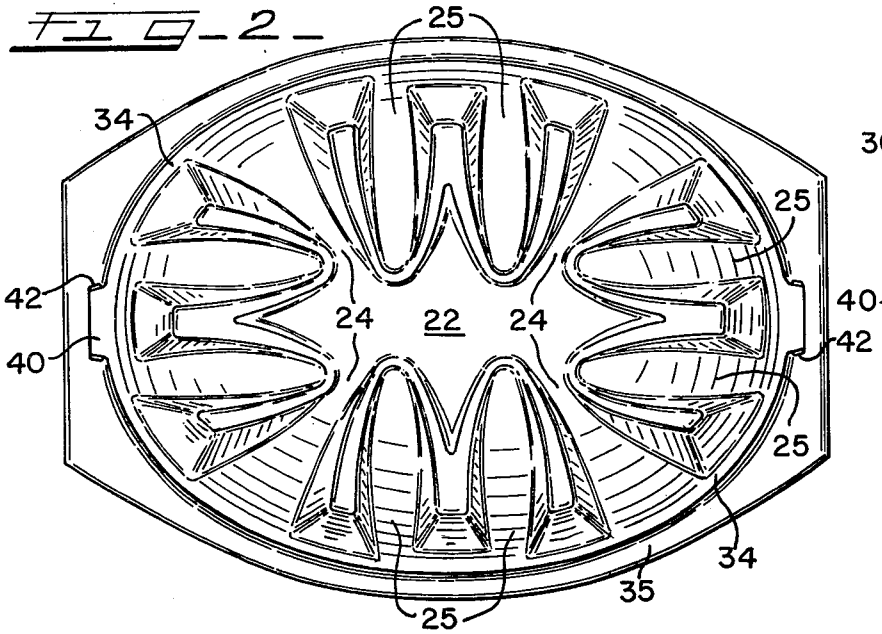
FIG. 2 is a top view of one embodiment of the subject invention.

The top cover 12 has a pair of tabs 40, each on an opposing side of the cover 12. Slots 42 are formed on the side wall 54 above the supportive band 32. The tabs 40, upon slight deformation of the top 12 caused by pressing the sides at the point of the tabs 40 inward, slip into the slots 42 for retention of the cover 12 by the bottom plate 14 (FIG. 2).

Both the cover 12 and the bottom plate 14 are easily nestable for separate storage in a minimum of space prior to use.

Figure 8:
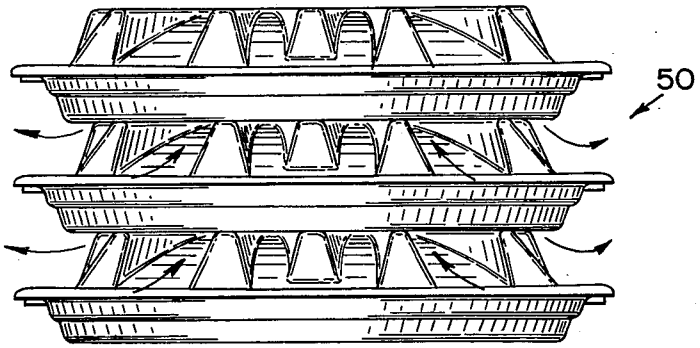
FIG. 8 is a perspective view of three or more food plate packages, stacked one on top of the other; and, FIG. 9 is a cross-sectional view of a single unit taken along the line 9—9 of FIG. 2, showing a stacked arrangement and the raised ribs and the paths between the ribs by which air may circulate between stacked containers.

The cover 12 has a series of raised support and reinforcing ribs 16 about the periphery of the cover extending substantially radially inwardly, in spaced relation. The support ribs 16 provide important functions when the food packages 10 are stacked one on top of the other, as indicated in FIG. 8. More specifically, the ribs 16 provide a stable support area or surface for the package resting on them and also provide paths for the circulation of air between the stacked packages. These ribs 16 present upper surfaces 18, which are substantially horizontal and raised from the surface of the cover 12, though to a much greater degree near the periphery of the cover 34 from which it is spaced, see FIG. 8. The lower portion 20 of the rib broadens in width as it extends to the surface of the cover 12 providing a stable support surface. The height of the ribs, with respect to the cover exterior, decreases as they approach the center. Thus, overall, the ribs present a uniform support base for the plate of a package resting on top.

The ribs impart sufficient strength to the cover so that the cover itself has a structural strength beyond that normally associated with a foamed polystyrene object, and can support loads many times in excess of its normal capacity. This improved capacity allows many such food plate packages to be stacked, conserving a great amount of space.

These ribs may take any form, however, in the preferred embodiment, a path for the circulation of air to the central portion 22 of the cover 12 is provided. For example, U-shaped ribs forming a series of stylized "M"'s, which comprise a design logo of the assignee of the present invention, is depicted in the drawings. The bight of each of the U-shaped ribs extends towards the center of the cover whereby channels 24 remain between each stylized "M" for the circulation of air to the central portion 22 (FIGS. 2 and 9). Air spaces 25 are also created by the ribs 16 which allow the heat from a stacked package above to dissipate, reaching a cooler level before contact with the cover exterior 12, while also providing for the circulation of air to the plate of the package stacked above. The effect of these ribs can be seen to provide a minimum of contact between adjacent packages in a stack, and at the same time, provide a maximum of support to allow many packages to be stacked on top of one another. Spaced ribs radiating from points spaced from the center of the cover may be used and are contemplated as within the subject invention.

The present inventive food plate packages 10 may be stacked, one on top of the other, with the bottom plate 14 of the food package being supported by the ribs 16 on the food package top cover 12 below it. Further, while so stacked, the ribs 16 also provide a cooling effect to the package to prevent the loss of its structural strength.

The inherent strength associated with the spherical shape present in the subject invention, in combination with a series of ribs 16, is more than adequate to support a plurality of the stacked food packages of the subject invention.

The top cover 12 retains its strength by eliminating the buildup of heat caused from the close association of adjacent packages when stacked by circulating air through channels (FIG. 9) and thereby cooling off the center portion 22 of the top cover 12. The natural convection currents (shown as arrows in FIG. 8), resulting from the proximity of the hot food plate packages 10 in a stack (FIG. 8), provide sufficient air flow through the channels 24 to cool the individual food plate packages in a stack. The convection currents established by the channels 24 are enhanced by the heating and cooling systems of restaurants which necessarily provide a constant, fresh flow of air to both the cooking and dining areas of the restaurant. Thus, the food packages will tend to be maintained at a temperature below that which would cause it to sag and even below that which would cause sticking of adjacent food packages.

While raised ribs generally have been found adequate to provide support, ribs having a flat upper surface have been found somewhat more desirable sice they tend to provide more friction and to prevent the sliding of one food plate package over another. Therefore, in the preferred embodiment, the top surface 18 of each rib is substantially flat (FIG. 9). When the flat bottom 46 of the lower plate 14 is placed on the top cover of another food plate package, as when stacking (see FIG. 8), a relatively large surface area 18 of the cover 12 is in frictional contact with the bottom plate 14. The foregoing prevents sliding of the individual packages in the stack and thus, are convenient for both carry-out and temporary storage purposes.

Figure 7:
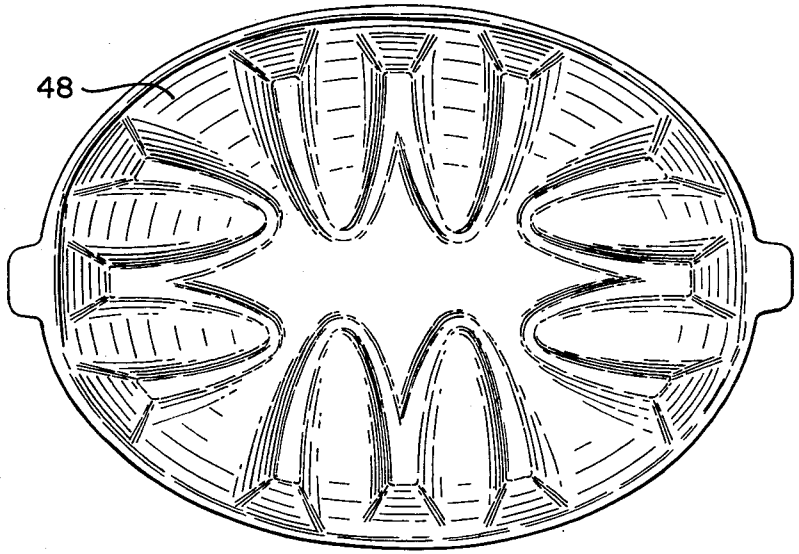
FIG. 7 is an inside view of the top cover of the subject invention.

In addition to the structural characteristics of cover 12, its spherical shape of its interior 48 also aids in keeping the food contents at the desired hot temperatures. As can be appreciated from FIG. 7, interior 48 provides adequate room for the foodstuffs placed therein, and yet the air space within the interior of the cover 12 is kept to a minimum. In this manner, the warmed food loses a minimum of heat in reaching a temperature equilibrium with the air contained in the package, and thus, stays warmer longer.

Figure 5:
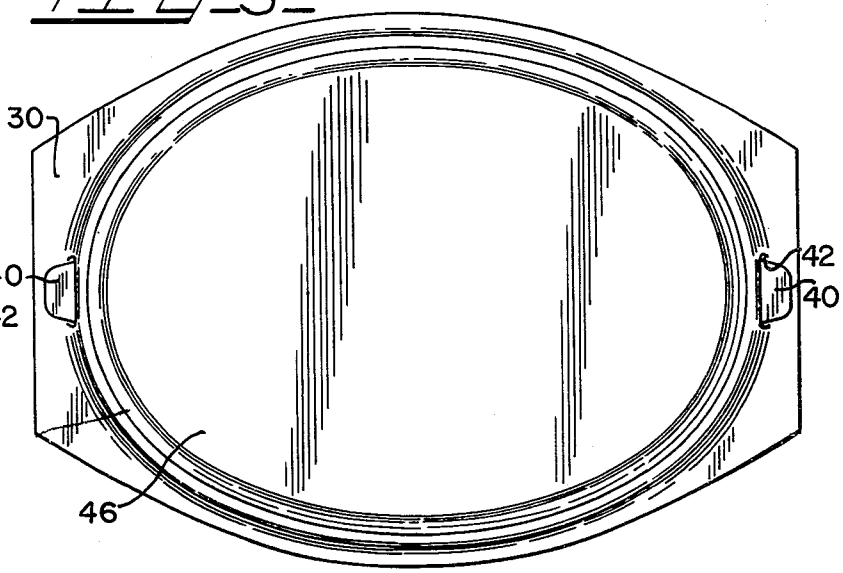
FIG. 5 is a bottom view of one embodiment of the subject invention.

The flat bottom 46 (FIG. 5), when resting on the ribs 16 of the package beneath, as stated above, gives the stack of packages 50 great stability, enough to withstand forces which would normally be sufficient to overturn the stack 50. Of course, the primary concern, that of keeping the food warm and fresh, is accomplished in spite of the extremity of the outdoor elements encountered.

Upon a consideration of the foregoing, it will become obvious to those skilled in the art that various modifications may be made without departing from the invention embodied herein. Therefore, only such limitations should be imposed as are indicated by the spirit and scope of the appended claims.

I claim:

1. A package of lightweight thermoplastic material for use in the storage of heated foods, said package being effective to maintain the heat and flavor of hot food contained therein, said lightweight thermoplastic material normally deforming if a wall of said package reaches the temperature of said hot foods, as occurs when adjacent packages are stacked on each other without provision for the circulation of cooling air between said adjacent packages, said package comprising in combination, a plate, said plate being shaped to receive heated foods, a generally bowl-shaped cover adapted to cover said plate to maintain said foods in a heated condition, a plurality of ribs formed on an outside surface of said cover and being spaced each from the other, each of said ribs being raised from said outside surface to form a planar upper surface, each of said planar upper surfaces of said plurality of ribs cooperating to form a substantially horizontal upwardly facing support surface to receive a plate of a similar package, each of said ribs having at least one generally U-shaped portion to form a bight, the bight of each of said U-shaped ribs generally extending toward the center of said cover from a point in close proximity to the periphery of said cover, the spacing between each of said ribs defining a channel directed toward the center of said cover to allow passage of cooling air over said cover and under the plate of a vertically adjacent package to maintain the temperature of the outside surface of said cover below that of the food contained therein, thereby preventing deformation of said cover due to excessive heat while maintaining said foods at a temperature suitable for consumption and simultaneously providing substantially rigid support for a stack of packages.

2. The package of claim 1 wherein each of said ribs has an upper portion and a lower portion, said lower portion being wider than said upper portion and gradually tapering to said upper portion.

3. The package of claim 1 whereby the height of each of said ribs tapers from a maximum height near the periphery of said cover to a minimum height near a central portion of said cover to form a substantially uniform upper support to provide a stable base.

4. The package of claim 1 wherein said package is formed of foamed polystyrene.

5. The package of claim 1 wherein a central portion of said cover is lower than said ribs.

6. The package of claim 1 wherein said ribs are radially extending from a central portion of said cover.

7. The package of claim 1 wherein said radially extending ribs are discontinuous to form said channels.

8. The package of claim 1 wherein each of said ribs have a substantially flat and horizontal upper portion.

9. The package of claim 1 wherein said channels maximize air space and said base maximizes support while minimizing surface contact between adjacent stacked packages.

* * * * *